US008794577B2

(12) United States Patent
Laera

(10) Patent No.: US 8,794,577 B2
(45) Date of Patent: Aug. 5, 2014

(54) MOUNTING SYSTEM FOR UNDER-MOUNT SINKS

(76) Inventor: Vito Laera, Fort Lauderdale, FL (US)

( * ) Notice: Subject to any disclaimer, the term of this patent is extended or adjusted under 35 U.S.C. 154(b) by 253 days.

(21) Appl. No.: 13/084,676

(22) Filed: Apr. 12, 2011

(65) Prior Publication Data

US 2012/0261533 A1 Oct. 18, 2012

(51) Int. Cl.
*F16M 11/00* (2006.01)

(52) U.S. Cl.
USPC ..... 248/201; 248/146; 248/149; 248/298.1; 4/619; 4/630; 4/631; 4/633

(58) Field of Classification Search
USPC ..... 4/630, 631, 633, 643, 647, 648; 248/201, 298.1, 146, 149, 312.1; 312/228
See application file for complete search history.

(56) References Cited

U.S. PATENT DOCUMENTS

| | | | | |
|---|---|---|---|---|
| 591,664 | A | 10/1897 | Badanes | |
| 959,437 | A | 5/1910 | Martin | |
| 4,175,292 | A * | 11/1979 | Morrison | 4/660 |
| 5,538,206 | A | 7/1996 | Sather | |
| 5,743,501 | A | 4/1998 | Rapp | |
| 6,293,322 | B1 | 9/2001 | Wilson-South | |
| 6,530,097 | B1 | 3/2003 | Sung | |
| 6,691,341 | B2 | 2/2004 | Loch | |
| 6,793,190 | B2 * | 9/2004 | White et al. | 248/500 |
| 7,429,021 | B2 | 9/2008 | Sather et al. | |
| 7,698,753 | B2 | 4/2010 | Jones et al. | |
| 7,979,929 | B2 * | 7/2011 | Vogel et al. | 4/695 |
| 2010/0230563 | A1 | 9/2010 | Flynn | |

* cited by examiner

*Primary Examiner* — Amy J Sterling
(74) *Attorney, Agent, or Firm* — Hammer & Associates, P.C.

(57) ABSTRACT

A system for mounting a sink to the under-side of a countertop, the sink having a bowl and a laterally extending flange emanating from the bowl, comprising: a pair of rigid side mounting rails adapted to engage the underside of the flange and adapted to engage a side wall of a cabinet on which the countertop is mounted; the side mounted rails being "L" shaped and each having a plurality of openings spaced along the length of the side mounting rails, the openings being adapted to engage a plurality of fasteners and a plurality of threaded bolts; a rigid front mounting rail adapted to engage the underside of the flange and adapted to engaged the front wall of a cabinet on which the countertop is mounted; the front mounted rail being "L" shaped and having a plurality of openings spaced along the length of the side mounting rails, the openings being adapted to engage a plurality of fasteners and a plurality of threaded bolts; the plurality of threaded bolts is adapted to engage the plurality of openings in the side mounting rails and the front mounting rail and adapted to engage a plurality of mounting cups which are operatively associated with a plurality of mounting devices selected from the group comprising: mounting cups, mounting clips, or a combination thereof; and the plurality of mounting devices is adapted to engage the threaded bolts and adapted to engage the underside of the flange of the sink.

17 Claims, 10 Drawing Sheets

MOUNTING SYSTEM FOR UNDER-MOUNT SINKS

FIELD OF THE INVENTION

The invention relates to a mounting system for sinks.

BACKGROUND OF THE INVENTION

A variety of techniques and devices have been utilized to mount sinks and basins to the underside of cabinet countertops. One of the more common systems is the use of wood framing under the counter where the sink is mounted. This technique requires a custom wood frame for each installation which is simple to construct, however it is also unsightly and often takes up valuable storage space from within the cabinet. Another common system includes the use of brackets which must be installed on top of the cabinet walls and underneath the cabinet countertops. Examples of this system include U.S. Pat. Nos. 5,743,501, 5,538,206, 7,429,021 and 7,698,753.

U.S. Pat. No. 5,743,501 discloses a system for mounting a sink using four mounting brackets which engage to a vertical support and two rails which extend along each side of a sink. A plurality of vertically adjustable leveling bolts are engaged to the rails to level the sink from underneath. The rails are u-shaped with walls and a rib which is used to hold a nut which holds the leveling bolts in place.

U.S. Pat. No. 5,538,206 discloses a system for mounting a sink using a cross member with a mounting bracket at each end. The mounting brackets are rest on the top of a counter wall on one end and attached to the cross member at the other end. The sink basically sits on top of two cross members which act as a cradle.

U.S. Pat. No. 7,429,021 discloses a system for mounting a sink to a support structure which includes two support cross-members which are each engaged by an additional channel member to support a sink. The cross members are hung from the cabinet walls using brackets secured to the cabinet walls. U.S. Pat. No. 7,698,753 discloses a system very similar to '021 above except that the support-cross members are curved for use with a different sink configuration.

However, none of the mounting systems in the prior are allow for the removal of a mounting system without also removing and potentially damaging the countertop. Hence, there exists an unsatisfied need for a simple, efficient yet removable system for mounting a sink to the under-side of a countertop.

SUMMARY OF THE INVENTION

A system for mounting a sink to the under-side of a countertop, the sink having a bowl and a laterally extending flange emanating from the bowl, comprising: a pair of rigid side mounting rails adapted to engage the underside of the flange and adapted to engage a side wall of a cabinet on which the countertop is mounted; the side mounted rails being "L" shaped and each having a plurality of openings spaced along the length of the side mounting rails, the openings being adapted to engage a plurality of fasteners and a plurality of threaded bolts; a rigid front mounting rail adapted to engage the underside of the flange and adapted to engaged the front wall of a cabinet on which the countertop is mounted; the front mounted rail being "L" shaped and having a plurality of openings spaced along the length of the side mounting rails, the openings being adapted to engage a plurality of fasteners and a plurality of threaded bolts; the plurality of threaded bolts is adapted to engage the plurality of openings in the side mounting rails and the front mounting rail and adapted to engage a plurality of mounting cups which are operatively associated with a plurality of mounting devices selected from the group comprising: mounting cups, mounting clips, or a combination thereof; and the plurality of mounting devices is adapted to engage the threaded bolts and adapted to engage the underside of the flange of the sink.

BRIEF DESCRIPTION OF THE DRAWINGS

For the purpose of illustrating the invention, there is shown in the figures a form that is presently preferred; it being understood, however, that this invention is not limited to the precise arrangements and instrumentalities shown.

DETAILED DESCRIPTION

Figure 1:
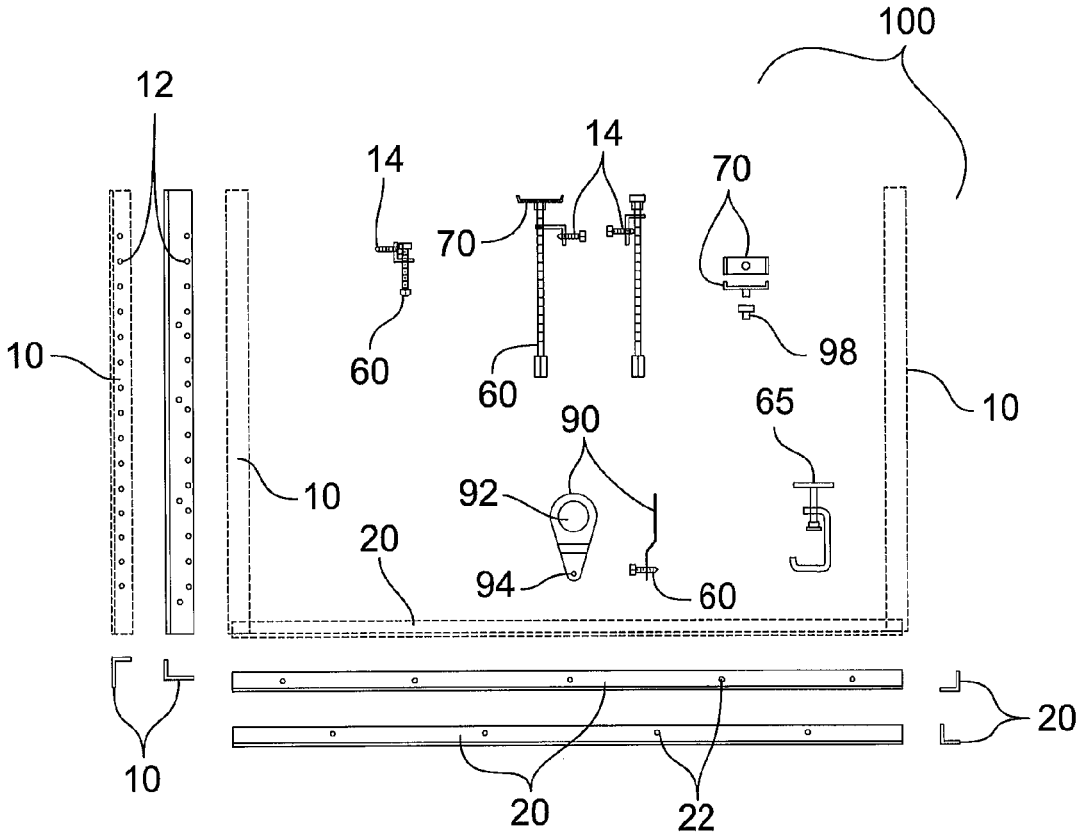
FIG. 1 illustrates an embodiment of a mounting system.
Figure 2A:
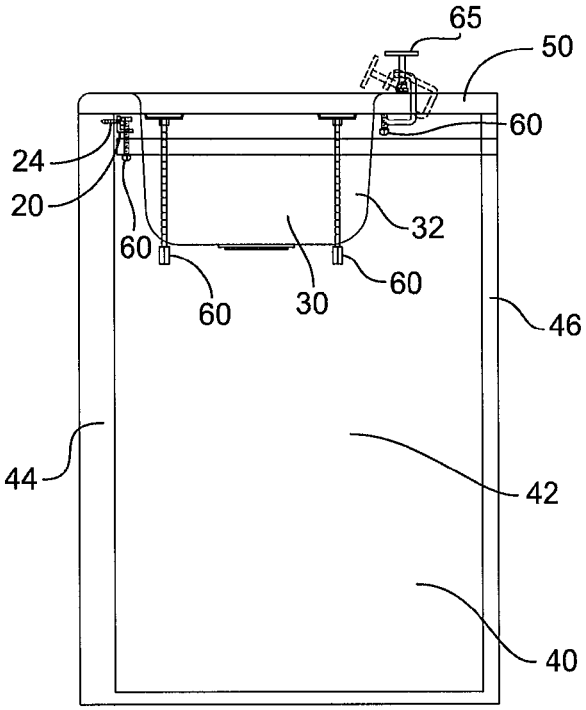
FIG. 2 illustrates a side view of a mounting system in use.
Figure 2B:
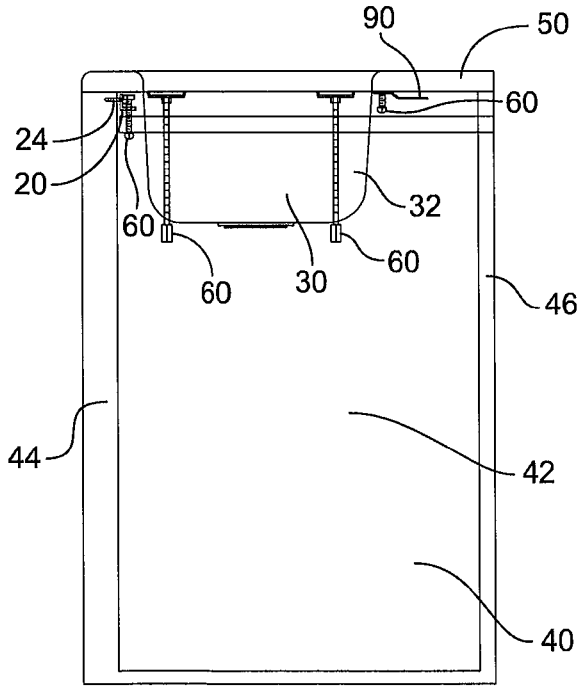
Figure 3:
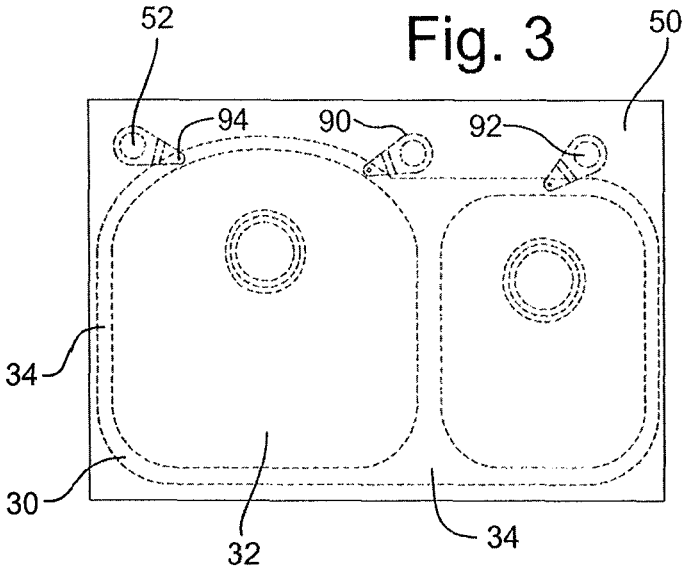
FIG. 3 illustrates a top view of a mounting system in use.

The present invention describes a system 100 for mounting a sink 30 to the under-side of a countertop 50. Looking to FIGS. 1-3, we see an embodiment of the system 100 which is comprised of a pair of rigid side mounting rails 10, a rigid front mounting rail 20, a plurality of fasteners 14, 24 a plurality of threaded bolts 60 and a plurality of mounting devices 70, 98. The system may also include one or more brackets 90, one or more clamps 65 or a combination thereof.

Sink 30, as used herein, refers to a bowl shaped fixture found most often in bathrooms, lavatories and kitchens, but may also be found in places such as laundry rooms, mud rooms and garages. Sinks may be made of a variety of materials and take on a variety of shapes. Materials include, but are not limited to, metals or alloys (stainless steel, cast iron, enameled cast iron, copper, etc.), stone (granite, concrete, marble, soapstone, etc.), ceramic, terrazzo, wood, glass and plastic. The present invention is concerned with sinks which are mounted from underneath a countertop as opposed to sinks which are mounted by resting on top of a countertop. Bottom-mount or under-mount sinks, as used herein, refers to a sink 30 having a bowl 32 and a laterally extending flange 34 emanating from the bowl 32.

Countertop 50 (FIGS. 2 and 3), as used herein, refers to a horizontal surface in kitchens, bathrooms, lavatories and workrooms which is generally installed upon a cabinet 40. A cabinet 40 (FIGS. 2 and 6-9), as used herein, refers to a piece of furniture generally having four sides which include two side walls 42, a front wall 44 and a back wall 46. In one embodiment of the present invention, the two side walls 42 are parallel to one another, the front wall 44 and the side wall 46 are parallel to one another, and the front wall 44 and the back wall 46 are perpendicular to the side walls 42. In another embodiment of the present invention, the two side walls 42 are not parallel to one another and the front wall 44 and the back wall 46 are parallel to one another. One or more sinks 30 may be installed within or below a hole in a countertop 50. Under-mount sinks are mounted to the underside of a countertop 50. Looking to FIG. 3, the countertop 50 may also include one or more openings 52 which are operatively associated with a faucet, a handle, a sprayer, a liquid dispenser, or any combination thereof.

Figure 4:
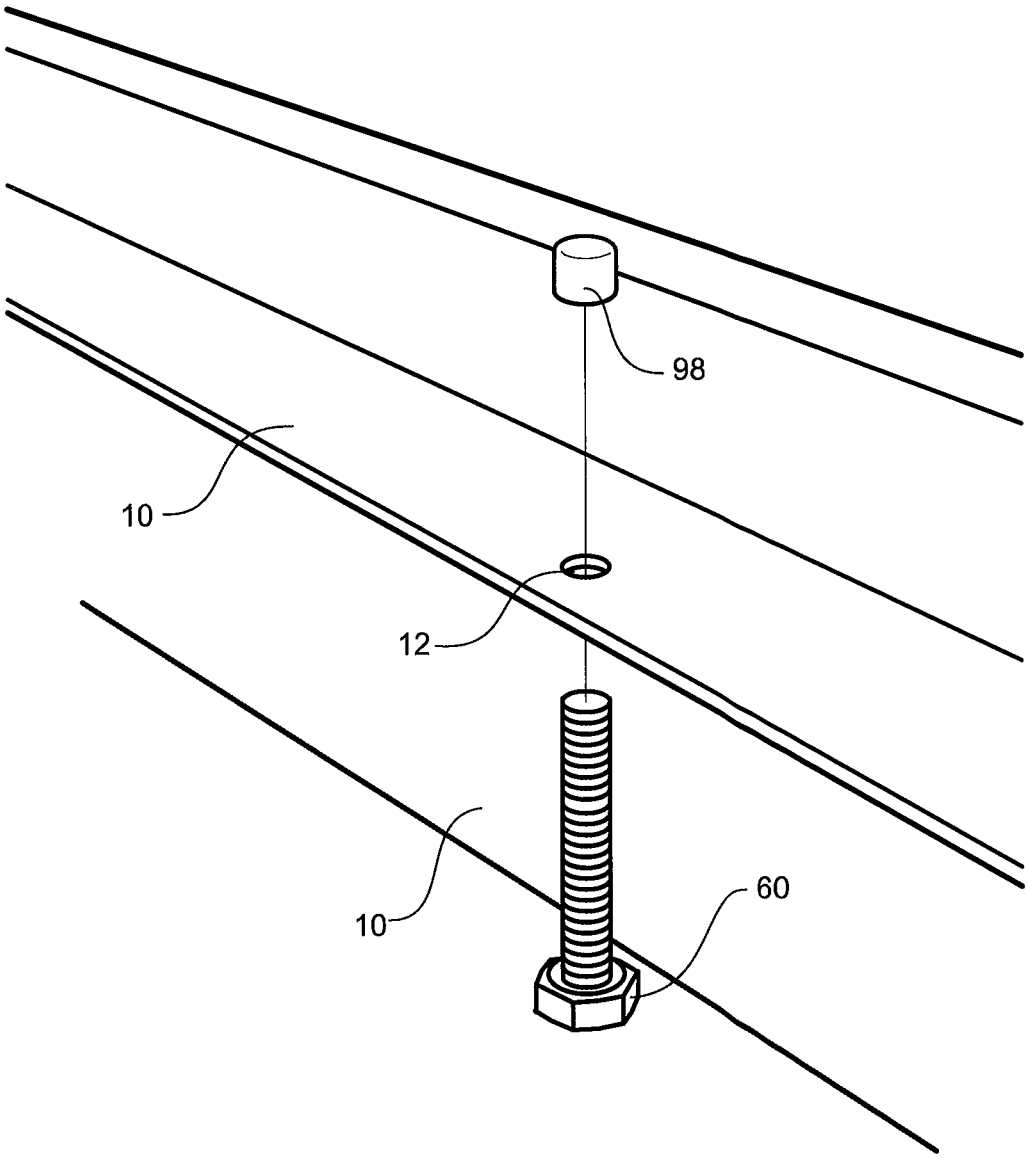
FIG. 4 illustrates a profile view of a threaded bolt and a mounting cup.

Side mounting rails 10, as used herein, refers to a rigid mounting rail adapted to both engage the underside of the flange 34 of a sink 30 and adapted to engage a side wall 42 of a cabinet 40 (See FIGS. 8 and 9) on which a countertop 50 is mounted. Looking to FIG. 1 we see an embodiment where the side mounted rails 10 are "L" shaped and each have a plurality of openings 12 spaced along the length of the side mounting rail 10. The plurality of openings 12 are adapted to engage a plurality of fasteners 14 (See FIG. 9) and a plurality of threaded bolts 60. In one embodiment of the present invention, the openings 12 in the side mounting rails 10 are smooth. In another embodiment of the present invention, the openings 12 in the side mounting 10 rail are threaded and are operatively associated with threaded bolts 60. In still another embodiment of the present invention, the openings 12 in the side mounting rail 10 include both smooth openings and threaded openings. In another embodiment of the present invention (See FIG. 4), the openings 12 in the side mounting rails 12 are threaded and designed to mate with a complimentary thread on a threaded bolt 60 or a fastener 14. In another embodiment of the present invention, the side mounting rails 10 are comprised of one or more metals. In still another embodiment of the present invention, the length of the side mounting rails 10 is in the range of 20 to 100 centimeters. In yet another embodiment, the length of the side mounting rails 10 is in the range of 30 to 90 centimeters. In still another embodiment, the length of the side mounting rails 10 is in the range of 40 to 75 centimeters. In another embodiment of the present invention, the side mounting rails 10 have a thickness in the range of 2 to 8 millimeters. In yet another embodiment, the side mounting rails 10 have a thickness in the range of 2 to 6 millimeters. In still another embodiment, the side mounting rails 10 have a thickness in the range of 2 to 4 millimeters. In another embodiment, the side mounting rails 10 have a thickness of 3 millimeters. In one embodiment of the present invention, the side mounting rails 10 have a width ranging from 5 centimeters by 5 centimeters to 2 centimeters by 2 centimeters including any combination therein.

Front mounting rail 20, as used herein, refers to a rigid mounting rail adapted to both engage the underside of the flange 34 of a sink 30 and adapted to engaged the front wall 44 of a cabinet 40 (See FIG. 8) on which a countertop 50 is mounted. The front mounted rail 20 is "L" shaped and has a plurality of openings 22 spaced along the length of the front mounting rail 20. The plurality of openings 22 are adapted to engage a plurality of fasteners 24 (See FIG. 2) and/or a plurality of threaded bolts 60. In one embodiment of the present invention, the openings 22 in the front mounting rail 20 are smooth. In another embodiment of the present invention, the openings in the front mounting rail 20 are threaded and are operatively associated with threaded bolts 60. In still another embodiment of the present invention, the openings 22 in the front mounting rail 20 include both smooth openings and threaded openings. In another embodiment of the present invention, the openings 22 in the front mounting rail 22 are threaded and designed to mate with a complimentary thread on a threaded bolt 60 or a fastener 24. In another embodiment of the present invention, the front mounting rail 20 is comprised of one or more metals. In still another embodiment of the present invention, the length of the front mounting rail 20 is in the range of 20 to 125 centimeters. In yet another embodiment, the length of the front mounting rail 20 is in the range of 30 to 115 centimeters. In still another embodiment, the length of the front mounting rail 20 is in the range of 40 to 100 centimeters. In yet another embodiment, the length of the front mounting rail 20 is in the range of 50 to 90 centimeters. In another embodiment of the present invention, the front mounting rail 20 has a thickness in the range of 2 to 8 millimeters. In yet another embodiment, the front mounting rail 20 has a thickness in the range of 2 to 6 millimeters. In still another embodiment, the front mounting rail 20 has a thickness in the range of 2 to 4 millimeters. In another embodiment, the front mounting rail 20 has a thickness of 3 millimeters. In one embodiment of the present invention, the front mounting rail 20 has a width ranging from 5 centimeters by 5 centimeters to 2 centimeters by 2 centimeters including any combination therein.

Fastener 14 (FIGS. 1 and 8), as used herein, refers to a device which is used to secure a side mounting rail 10 to a side wall 42 to the inside of a cabinet 40. Fastener 24 (FIG. 2), as used herein, may also refer to a device which is used to secure a front mounting rail 20 to a front wall 44 to the inside of a cabinet 40. Fastener may also refer to a device which is used to secure a bracket 90 (FIGS. 1 and 3) to the underside of a countertop 50. In one embodiment of the present invention a fastener (14, 24) may be selected from the group comprising: bolts, nails, screws, adhesives, clips, cotter pins, rivets, snaps, retaining nuts, locknuts or a combination thereof.

Threaded bolts 60 (FIGS. 1-2, 4-5 and 6-9), as used herein, refers to a type of fastener characterized by a helical ridge or thread wrapped around the cylinder. In one embodiment of the present invention, the threaded bolts 60 are adapted to engage a plurality of mounting devices selected from the group comprising: mounting clips 70, mounting cups 98 (FIGS. 1-2, 4-6 and 8-9), or a combination thereof. In another embodiment of the present invention, a plurality of threaded bolts 60 are adapted to engage a plurality of openings 12 in the side mounting rails 10 and a plurality of openings 22 in the front mounting rail 20. In still another embodiment, the threaded bolts 60 are adapted to engage a plurality of openings 12 in the side mounting rails 10, a plurality of openings 22 in the front mounting rail 20 and a plurality of mounting devices 70, 98. In yet another embodiment, the threaded bolts 60 are adapted to engage a plurality of openings 12 in the side mounting rails 10, a plurality of openings 22 in the front mounting rail 20 and a plurality of mounting cups 98 which are operatively associated with a plurality of mounting clips 70. In still another embodiment, the threaded bolts 60 are adapted to engage a plurality of threaded openings 12 in the side mounting rails 10, a plurality of threaded openings 22 in the front mounting rail 20 and a plurality of mounting devices 70, 98.

Mounting device, as used herein, refers to a device which is adapted to engage a threaded bolt 60 and adapted to engage the underside of a flange 34 of a sink 30. A mounting device may be made of a variety of materials including, but not limited to, metal, plastic, rubber, wood, fibers, or a combination thereof. In one embodiment of the present invention, a mounting device may be selected from the group comprising: a mounting clip 70, a mounting cup 98, or a combination thereof.

Figure 5:
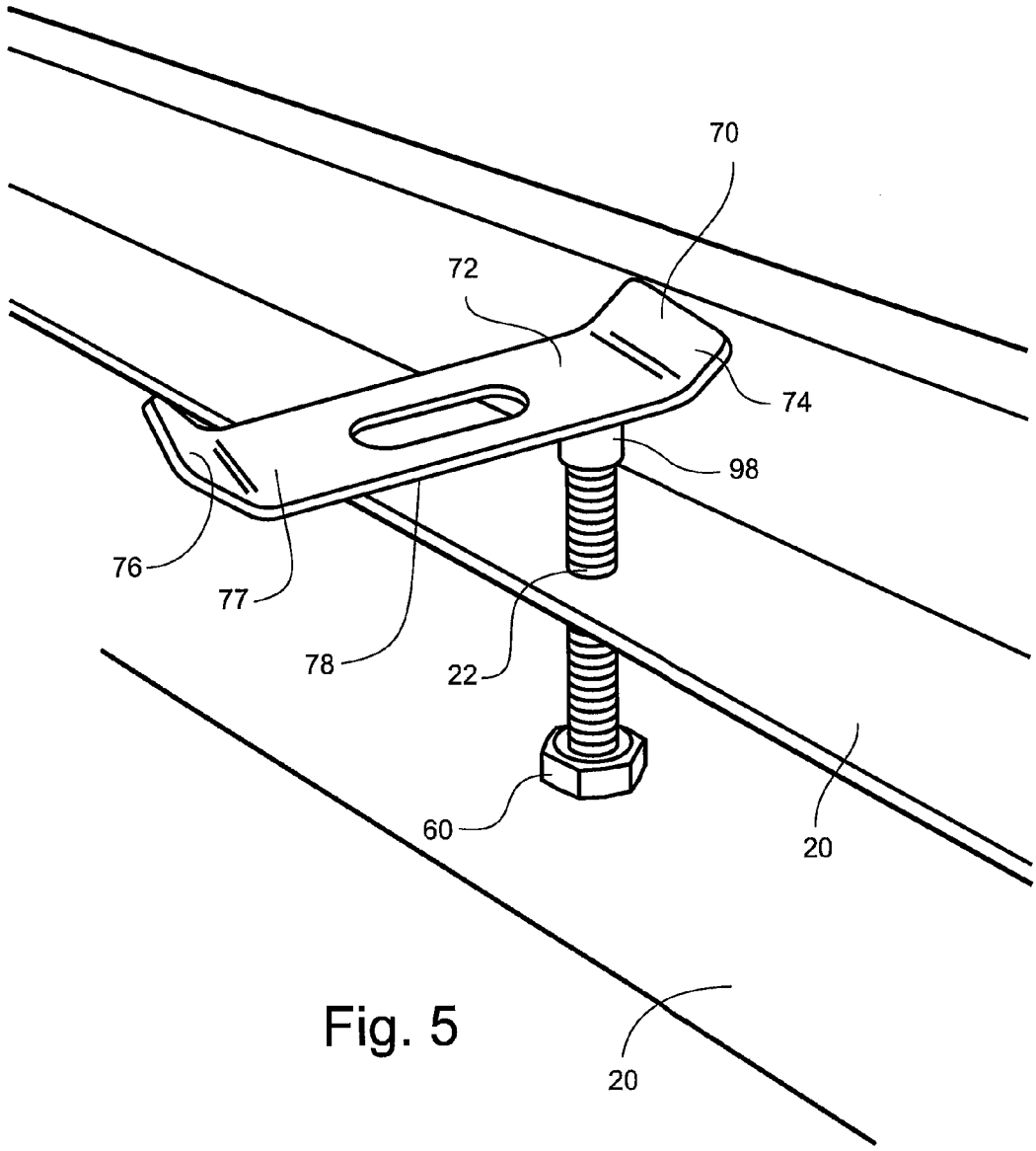
FIG. 5 illustrates a profile view of a threaded bolt and a mounting bracket.
Figure 9:
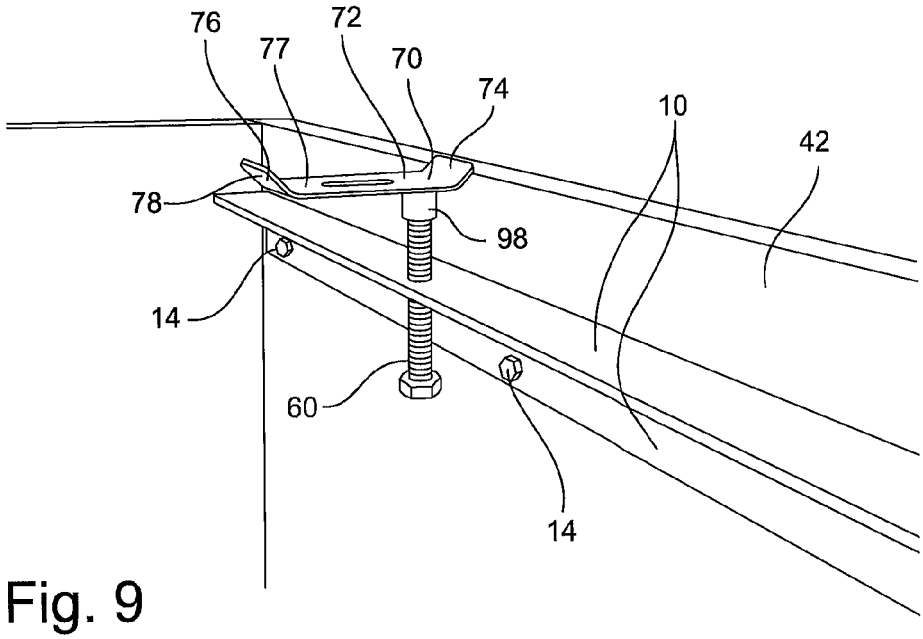
FIG. 9 illustrates a profile view of a mounting system installed within a cabinet.
Figure 10:
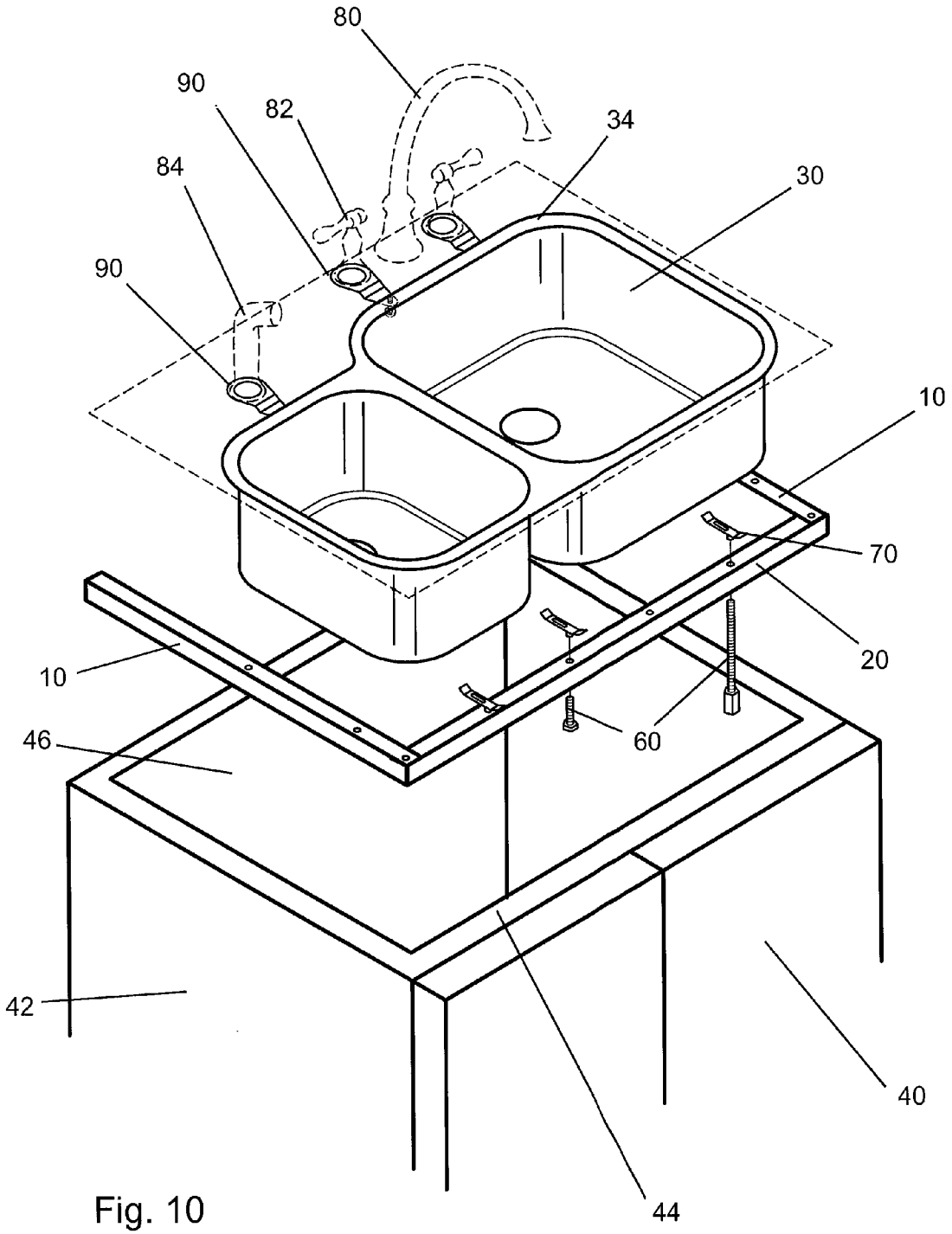
FIG. 10 illustrates an exploded view of a mounting system.
Figure 11:
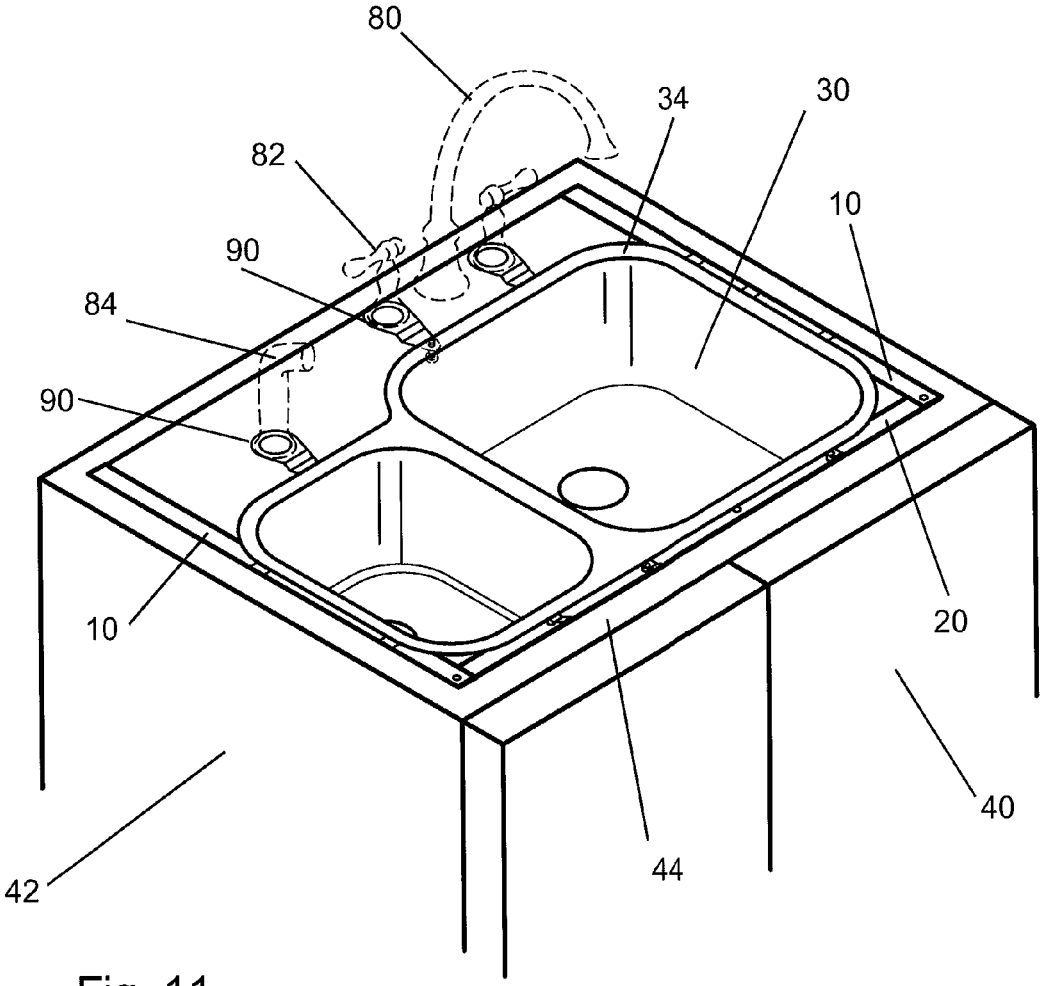
FIG. 11 illustrates a perspective view of a mounting system installed within a cabinet.

Mounting clip 70, as used herein, refers to a device which is adapted to engage a threaded bolt 60 and adapted to engage the underside of a flange 34 of a sink 30. In one embodiment, a mounting clip 70 may include a mounting cup 98 which is permanently attached to the mounting clip 70. A mounting cup 98 may be attached to a mounting clip 70 by any known means including, but not limited to, an adhesive, a weld, a fastener, or any combination thereof. In one embodiment of the present invention, a mounting cup 98 may be attached to the lower surface 78 of a mounting clip 70. FIG. 5 illustrates an embodiment of a mounting clip 70 which has a body 72, a proximal end 74, and a distal end 76. FIG. 9 illustrates one embodiment of a threaded bolt 60 engaging the lower surface 78 of a mounting clip at its proximal end 74 leaving the upper surface 77 available to engage the underside of a flange 34 of a sink. In one embodiment of the present invention, the body 72 of a mounting clip 70 may be solid. In another embodiment of the present invention, the body 72 of the mounting clip 70 may be hollow (see FIG. 5). In still another embodiment, the proximal end 74 and the distal end 76 of a mounting clip 70 may flare toward the upper surface 77 of the mounting clip.

Mounting cup 98, as used herein, refers to a device which is adapted to engage both a threaded bolt 60 and adapted to engage the underside of a flange 34 of a sink 30. In one embodiment, a mounting cup 98 has a smooth interior. In another embodiment, a mounting cup 98 has a threaded interior. In another embodiment, a mounting cup 98 is operatively associated with a threaded bolt 60 and is permanently attached to a mounting clip 70.

In one embodiment of the present invention the system for mounting a sink 100 includes threaded bolts 60 and mounting devices adapted to tightly secure a sink 30 to the under-side of a countertop 50 by axially turning the threaded bolts 60 in order to raise the mounting clips 70 and the sink 30 and press the sink 30 into the underside of the countertop 50. In another embodiment of the present invention, the system for mounting a sink 100 includes a plurality of threaded bolts 60 separately engaging both a plurality of mounting clips 70 and a plurality of mounting cups 98 adapted to tightly secure a sink 30 to the under-side of a countertop 50 by axially turning the threaded bolts 60 in order to raise the mounting clips 70 and the sink 30 and press the sink 30 into the underside of the countertop 50.

The present invention as described above may further include one or more openings 52 in the countertop 50 (FIG. 3), the openings 52 being adapted to accept a faucet, one or more handles, a sprayer, a liquid dispenser or a combination thereof. The embodiment may also include one or more brackets 90 operatively associated with the countertop openings 52 where the bracket has a large opening 92 on one end adapted to engage the countertop opening 52 and a small, threaded opening 94 on the opposite end adapted to engage a threaded bolt 60. The threaded bolt 60 is adapted to engage a mounting device 70, 98 which is adapted to engage the underside of a flange 34 of a sink 30. In one embodiment, the bracket 90 is mounted to the underside of a countertop 50 by placing the large opening 92 around a faucet, one or more handles, a sprayer or a liquid dispenser to engage the underside of the countertop 50 and be retained in place by a fastener.

The present invention as described above may further include one or more clamps 65 adapted to engage said sink flange 34, a faucet, one or more handles, a sprayer, a liquid dispenser, a countertop 50 or a combination thereof.

Figure 6:
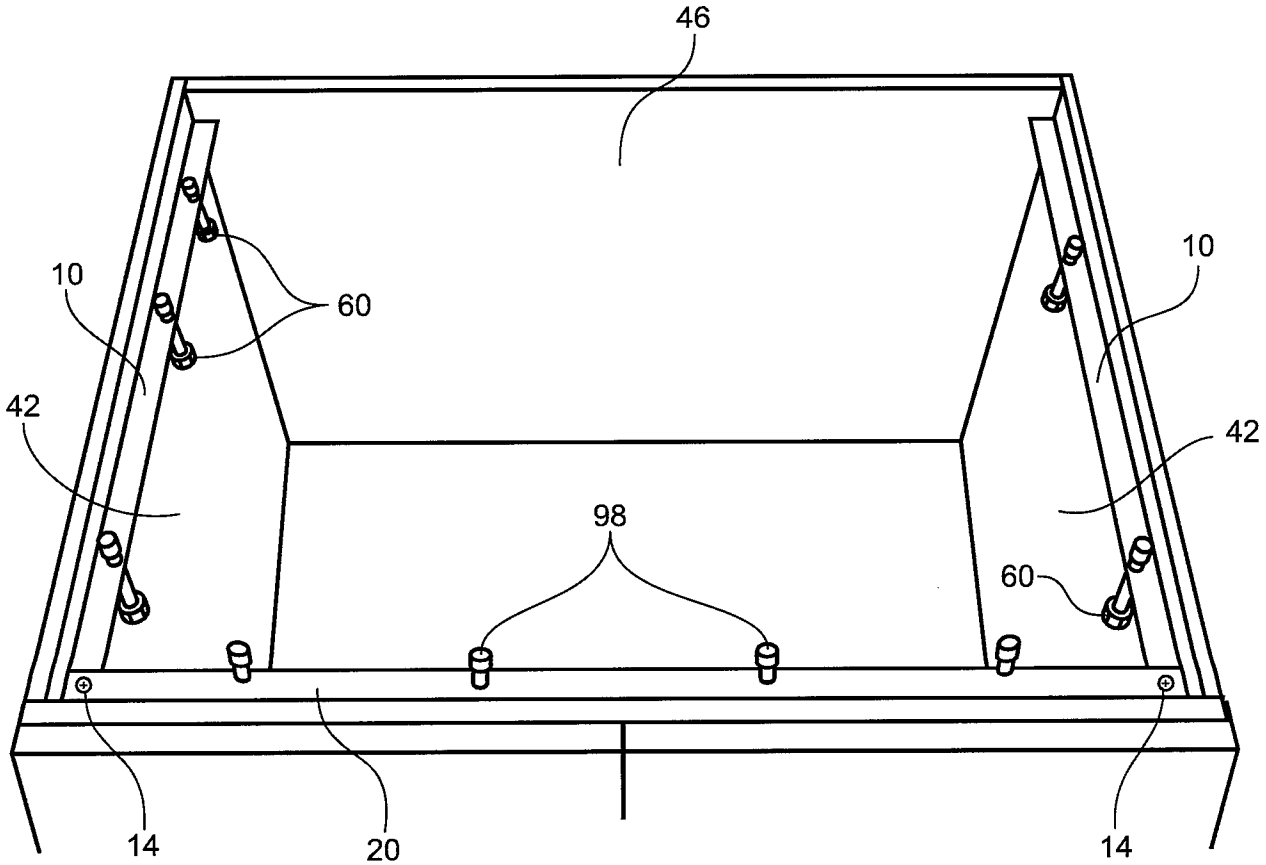
FIG. 6 illustrates a downward view of a mounting system installed within a cabinet.
Figure 7:
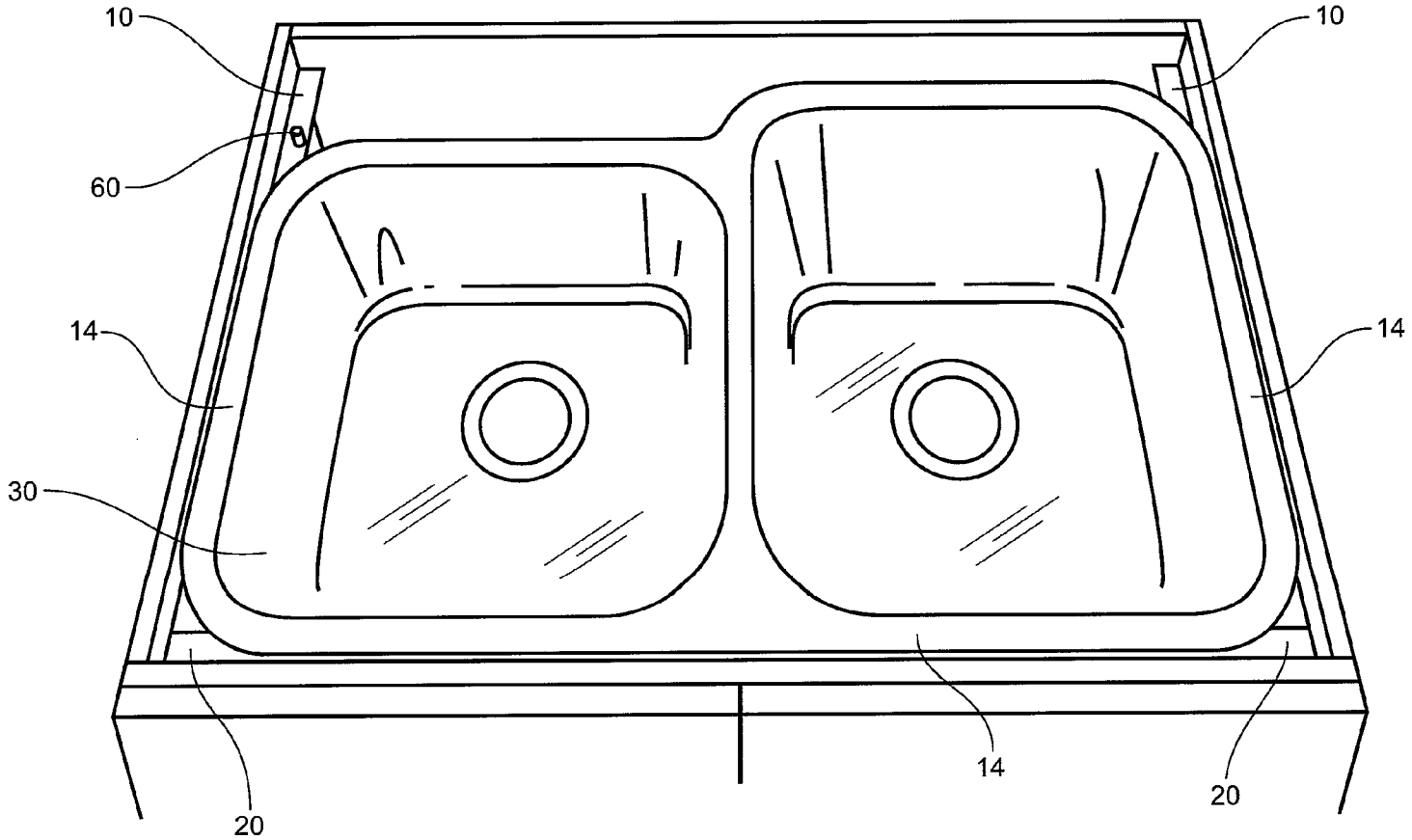
FIG. 7 illustrates a downward view of a mounting system installed within a cabinet including a sink.
Figure 8:
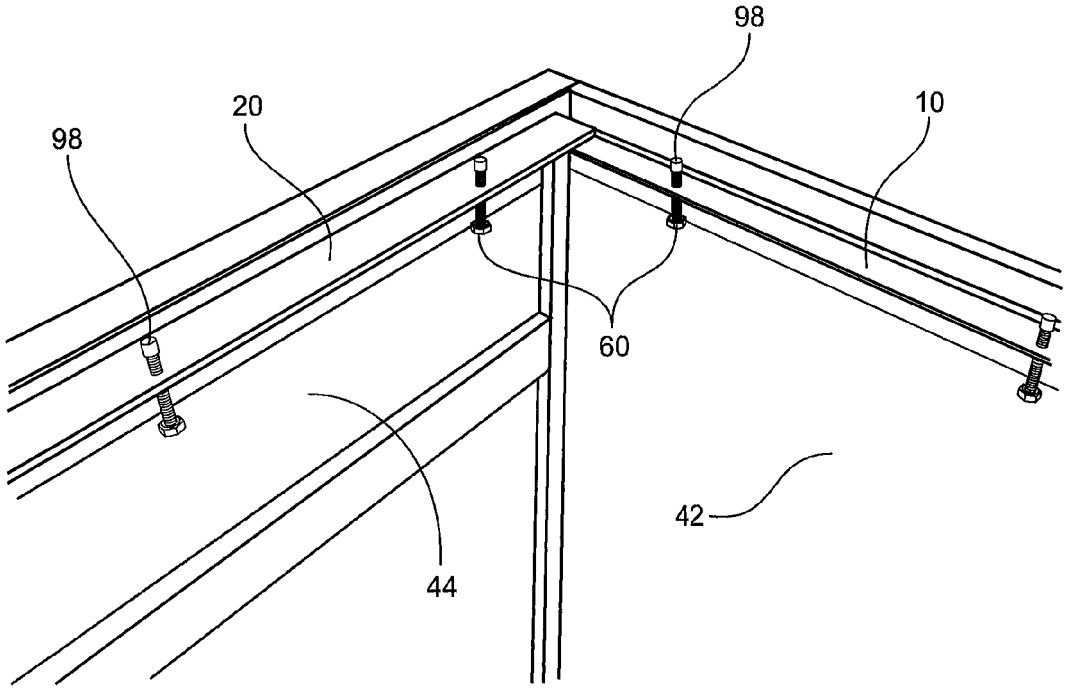
FIG. 8 illustrates a profile view of a mounting system installed within a cabinet.

In one embodiment of the present invention, the system 100 permits the removal of a sink 30 from the underside of a countertop 50 without also requiring the removal of the countertop 50. In another embodiment of the present invention, the side mounted rails 10 and the front mounted rail 20 are adapted to be secured to a pair of side walls 42 and a front wall 44 of a cabinet 40 without inserting any portion of the system 100 between the top of the side walls 42, the top of the front wall 44 and the underside of the countertop 50. In another embodiment of the present invention, one or more fasteners are used to secure each end of the front mounted rail 20 to one end of each side mounted rail 10 (FIG. 6).

One embodiment of the present invention includes a system 100 for mounting a sink 30 to the under-side of a countertop 50, the sink 30 having a bowl 32 and a laterally extending flange 34 emanating from the bowl 32, comprising: a pair of rigid side mounting rails 10 adapted to engage the underside of the flange 34 and adapted to engage a side wall 42 of a cabinet 40 on which the countertop 50 is mounted; the side mounted rails 10 being "L" shaped and each have a plurality of openings 12 spaced along the length of the side mounting rails 10, the openings 12 being adapted to engage a plurality of fasteners 14 and a plurality of threaded bolts 60; a rigid front mounting rail 20 adapted to engage the underside of the flange 34 and adapted to engaged the front wall 44 of a cabinet 40 on which the countertop 50 is mounted; the front mounted rail 20 being "L" shaped has a plurality of openings 22 spaced along the length of the side mounting rails 10, the openings 12 being adapted to engage a plurality of fasteners 34 and a plurality of threaded bolts 60; the plurality of threaded bolts 60 is adapted to engage the plurality of openings 12 in the side mounting rails 10 and the plurality of openings 22 front mounting rail 20 and adapted to engage a plurality of mounting devices selected from the group comprising: mounting clips 70, mounting cups 98, or a combination thereof; the plurality of mounting devices is adapted to engage the threaded bolts 60 and adapted to engage the underside of the flange 34 of the sink 30; one or more openings 52 in the countertop 50, the openings 52 being adapted to accept a faucet, one or more handles, a sprayer, a liquid dispenser or a combination thereof; one or more brackets 90 operatively associated with the countertop openings 52; and the bracket 60 having a large opening 92 on one end adapted to engage the countertop opening 52 and a small, threaded opening 94 on the opposite end adapted to engage a threaded bolt 60; the threaded bolt 60 being adapted to engage a mounting device which is adapted to engage the underside of a flange 34 of a sink 30; the bracket 90 is mounted by placing the large opening 92 around the faucet, one or more handles, sprayer or liquid dispenser to engage the underside of the countertop 50 and be retained in place by a fastener.

In another embodiment of the above system for mounting a sink 100 the fasteners 14, 24 are selected from the group comprising: bolts, nails, screws, adhesives, clips, cotter pins, rivets, snaps, retaining nuts, locknuts, or a combination thereof. In still another embodiment of the above system 100, the threaded bolts 60 and mounting devices are adapted to tightly secure the sink 30 to the under-side of the countertop 50 by axially turning the threaded bolts 60 in order to raise the mounting devices and the sink 30 and press the sink 30 into the underside of the countertop 50. In yet another embodiment of the above system 100, the openings 12 in the side mounting rails 10 and the openings 22 in the front mounting rail 20 are threaded and operatively associated with the threaded bolts 60.

In still another embodiment of the above system 100 may further comprise one or more clamps 65 adapted to engage the sink flange 34, a faucet, one or more handles, a sprayer, a liquid dispenser or a combination thereof. In yet another embodiment of the above system 100, the system 100 permits the removal of the sink 30 from the underside of the countertop 50 without the removal of the countertop 50. In still another embodiment of the above system 100, the mounting rails 10/20 are made of one or more metals. In still another embodiment of the above system 100, the plurality of threaded bolts 60 range in length from 2 to 30 centimeters. In yet another embodiment of the above system 100, the length of the side mounting rails 10 is in the range of 20 to 100 centimeters and the length of the front mounting rail 20 is the in range of 20 to 125 centimeters.

One embodiment of the present invention discloses a system for mounting a sink to the under-side of a countertop, the sink having a bowl and a laterally extending flange emanating from the bowl, comprising: a pair of rigid side mounting rails which engage the underside of the flange and which engage a side wall of a cabinet on which the countertop is mounted; the side mounted rails being "L" shaped and having a plurality of openings spaced along the length of the side mounting rails, the openings engage a plurality of fasteners and a plurality of threaded bolts; a rigid front mounting rail which engages the underside of the flange and which engages the front wall of a cabinet on which the countertop is mounted; the front mounted rail being "L" shaped and having a plurality of openings spaced along the length of the front mounting rail, the openings engage a plurality of fasteners and a plurality of threaded bolts; the plurality of threaded bolts engage the plurality of openings in the side mounting rails and the front mounting rail and engage a plurality of mounting devices selected from the group comprising: mounting cups, mounting clips, or a combination thereof; the plurality of mounting devices engage the threaded bolts and engage the underside of the flange of the sink; one or more openings in the countertop, the openings accept a faucet, one or more handles, a sprayer, a liquid dispenser or a combination thereof; one or more brackets operatively associated with the countertop openings; and the bracket having a large opening on one end which engages the countertop opening and a small, threaded opening on the opposite end which engages a threaded bolt; the threaded bolt engages a mounting device which engages the underside of the flange of the sink; the bracket being mounted by placing the large opening around the faucet, handle, sprayer or liquid dispenser to engage the underside of the countertop and be retained in place by a fastener.

The invention claimed is:

1. A system for mounting a sink to the under-side of a countertop, said sink having a bowl and a laterally extending flange emanating from said bowl, comprising:

a pair of rigid side mounting rails-adapted to engage a side wall of a cabinet on which said countertop is mounted;

said side mounted rails being "L" shaped and having a plurality of openings spaced along the length of the side mounting rails, said openings being adapted to engage a plurality of fasteners and a plurality of threaded bolts;

a rigid front mounting rail adapted to engage the front wall of a cabinet on which said countertop is mounted;

said front mounted rail being "L" shaped and having a plurality of openings spaced along the length of the front mounting rail, said openings being adapted to engage a plurality of fasteners and a plurality of threaded bolts;

wherein said openings in said side mounting rails and said front mounting rail being threaded and being operatively associated with said threaded bolts;

said plurality of threaded bolts adapted to engage said plurality of openings in said side mounting rails and said front mounting rail and adapted to engage a plurality of mounting devices selected from the group comprising: mounting cups, mounting clips, or a combination thereof; and said plurality of mounting devices adapted to engage said threaded bolts and adapted to engage the underside of said flange of said sink to secure said sink to the under-side of said countertop;

wherein said mounting cups are engaged from underneath by one of the threaded bolts and said mounting cups directly engage the underside of said flange of said sink to compress said flange between said mounting cups and the under-side of said countertop; and wherein said mounting clips include an attached mounting cup which is engaged from underneath by one of the threaded bolts and said mounting clips directly engage the underside of said flange of said sink to compress said flange between said mounting clips and the under-side of said countertop.

2. The system for mounting a sink as described in claim 1 wherein said fasteners being selected from the group comprising: bolts, nails, screws, adhesives, clips, cotter pins, rivets, snaps, retaining nuts, locknuts, or a combination thereof.

3. The system for mounting a sink as described in claim 1 wherein said threaded bolts and mounting devices being adapted to tightly secure said sink to the under-side of said countertop by axially turning said bolts in order to raise said mounting devices and said sink and press said sink into the underside of said countertop.

4. The system for mounting a sink as described in claim 1 further comprising:

one or more openings in said countertop, said openings being adapted to accept a faucet, one or more handles, a sprayer, a liquid dispenser or a combination thereof;

one or more brackets operatively associated with said countertop openings;

said bracket having a large opening on one end adapted to engage said countertop opening and a small opening on the opposite end adapted to engage a threaded bolt;

said small opening being threaded;

said threaded bolt being adapted to engage a mounting device adapted to engage the underside of said flange of said sink;

said bracket being mounted by placing said large opening around said faucet, handle, sprayer or liquid dispenser to engage the underside of said countertop and be retained in place by a fastener.

5. The system for mounting a sink as described in claim 1 further comprising one or more clamps adapted to engage said flange, a faucet, one or more handles, a sprayer, a liquid dispenser or a combination thereof.

6. The system for mounting a sink as described in claim 1 wherein said cabinet side walls being parallel to one another and said cabinet front wall and back wall being parallel to one another and perpendicular to said side walls.

7. The system for mounting a sink as described in claim 1 wherein said system permits the removal of said sink from the underside of said countertop without the removal of said countertop.

8. The system for mounting a sink as described in claim 1 wherein said mounting rails made of one or more metals.

9. The system for mounting a sink as described in claim 1 wherein said plurality of threaded bolts range in length from 2 to 30 centimeters.

10. The system for mounting a sink as described in claim 1 wherein the length of said side mounting rails is in the range of 20 to 100 centimeters and the length of said front mounting rail is the in range of 20 to 125 centimeters.

11. A system for mounting a sink to the under-side of a countertop, said sink having a bowl and a laterally extending flange emanating from said bowl, consisting essentially of:

a pair of rigid side mounting rails adapted to engage a side wall of a cabinet on which said countertop is mounted;

said side mounted rails being "L" shaped and having a plurality of openings spaced along the length of the side mounting rails, said openings being adapted to engage a plurality of fasteners and a plurality of threaded bolts;

a rigid front mounting rail adapted to engage the front wall of a cabinet on which said countertop is mounted;

said front mounted rail being "L" shaped and having a plurality of openings spaced along the length of the front mounting rail, said openings being adapted to engage a plurality of fasteners and a plurality of threaded bolts;

wherein said openings in said side mounting rails and said front mounting rail being threaded and being operatively associated with said threaded bolts;

said plurality of threaded bolts adapted to engage said plurality of openings in said side mounting rails and said front mounting rail and adapted to engage a plurality of mounting devices selected from the group consisting essentially of: mounting cups, mounting clips, or a combination thereof;

said plurality of mounting devices adapted to engage said threaded bolts and adapted to engage the underside of said flange of said sink to secure said sink to the under-side of said countertop;

wherein said mounting cups are engaged from underneath by one of the threaded bolts and said mounting cups directly engage the underside of said flange of said sink to compress said flange between said mounting cups and the under-side of said countertop; and wherein said mounting clips include an attached mounting cup which is engaged from underneath by one of the threaded bolts and said mounting clips directly engage the underside of said flange of said sink to compress said flange between said mounting clips and the under-side of said countertop;

one or more openings in said countertop, said openings being adapted to accept a faucet, one or more handles, a sprayer, a liquid dispenser or a combination thereof;

one or more brackets operatively associated with said countertop openings; and said bracket having a large opening on one end adapted to engage said countertop opening and a small opening on the opposite end adapted to engage a threaded bolt;

said small opening being threaded;

said threaded bolt being adapted to engage a mounting device adapted to engage the underside of said flange of said sink to secure said sink to the under-side of said countertop;

said bracket being mounted by placing said large opening around said faucet, handle, sprayer or liquid dispenser to engage the underside of said countertop and be retained in place by a fastener.

12. The system for mounting a sink as described in claim 11 wherein said fasteners being selected from the group comprising: bolts, nails, screws, adhesives, clips, cotter pins, rivets, snaps, retaining nuts, locknuts, or a combination thereof.

13. The system for mounting a sink as described in claim 11 wherein said threaded bolts and mounting devices being adapted to tightly secure said sink to the under-side of said countertop by axially turning said bolts in order to raise said mounting devices and said sink and press said sink into the underside of said countertop.

14. The system for mounting a sink as described in claim 11 wherein said system permits the removal of said sink from the underside of said countertop without the removal of said countertop.

15. The system for mounting a sink as described in claim 1 wherein said mounting rails made of one or more metals.

16. The system for mounting a sink as described in claim 11 wherein said plurality of threaded bolts range in length from 2 to 30 centimeters and the length of said side mounting rails is in the range of 20 to 100 centimeters and the length of said front mounting rail is the in range of 20 to 125 centimeters.

17. A system for mounting a sink to the under-side of a countertop, said sink having a bowl and a laterally extending flange emanating from said bowl, consisting essentially of:

a pair of rigid side mounting rails which engage a side wall of a cabinet on which said countertop is mounted;

said side mounted rails being "L" shaped and having a plurality of openings spaced along the length of the side mounting rails, said openings engage a plurality of fasteners and a plurality of threaded bolts;

a rigid front mounting rail which engages the front wall of a cabinet on which said countertop is mounted;

said front mounted rail being "L" shaped and having a plurality of openings spaced along the length of the front mounting rail, said openings engage a plurality of fasteners and a plurality of threaded bolts;

wherein said openings in said side mounting rails and said front mounting rail being threaded and being operatively associated with said threaded bolts;

said plurality of threaded bolts engage said plurality of openings in said side mounting rails and said front mounting rail and engage a plurality of mounting devices selected from the group consisting of: mounting cups, mounting clips, or a combination thereof;

said plurality of mounting devices engage said threaded bolts and engage the underside of said flange of said sink to secure said sink to the under-side of said countertop;

wherein said mounting cups are engaged from underneath by one of the threaded bolts and said mounting cups directly engage the underside of said flange of said sink to compress said flange between said mounting cups and the under-side of said countertop; and wherein said mounting clips include an attached mounting cup which is engaged from underneath by one of the threaded bolts and said mounting clips directly engage the underside of said flange of said sink to compress said flange between said mounting clips and the under-side of said countertop;

one or more openings in said countertop, said openings accept a faucet, one or more handles, a sprayer, a liquid dispenser or a combination thereof;

one or more brackets operatively associated with said countertop openings; and said bracket having a large opening on one end which engages said countertop opening and a small opening on the opposite end which engages a threaded bolt;

said small opening being threaded;

said threaded bolt engages a mounting device which engages the underside of said flange of said sink to secure said sink to the under-side of said countertop;

said bracket being mounted by placing said large opening around said faucet, handle, sprayer or liquid dispenser to engage the underside of said countertop and be retained in place by a fastener.

* * * * *